US006755519B2

(12) United States Patent
Gelbart et al.

(10) Patent No.: US 6,755,519 B2
(45) Date of Patent: Jun. 29, 2004

(54) METHOD FOR IMAGING WITH UV CURABLE INKS

(75) Inventors: Daniel Gelbart, Vancouver (CA); Murray Figov, Ra'anana (IL)

(73) Assignee: Creo Inc. (CA)

( * ) Notice: Subject to any disclaimer, the term of this patent is extended or adjusted under 35 U.S.C. 154(b) by 199 days.

(21) Appl. No.: 10/155,901

(22) Filed: May 24, 2002

(65) Prior Publication Data

US 2002/0191063 A1 Dec. 19, 2002

Related U.S. Application Data

(63) Continuation-in-part of application No. 09/654,247, filed on Mar. 8, 1999, now Pat. No. 6,409,331.

(51) Int. Cl.[7] ..... B41J 2/01
(52) U.S. Cl. ..... 347/103
(58) Field of Search ..... 347/103, 120, 347/20, 123, 111, 159, 141, 155, 127, 128, 17, 154, 61; 399/271, 290, 292, 293, 294, 33, 67, 320

(56) References Cited

U.S. PATENT DOCUMENTS

| | | | |
|---|---|---|---|
| 4,232,324 | A | 11/1980 | Tsao |
| 4,272,771 | A | 6/1981 | Furukawa |
| 4,293,866 | A | 10/1981 | Takita et al. |
| 4,538,156 | A | 8/1985 | Durkee et al. |
| 4,673,303 | A | 6/1987 | Sansone et al. |
| 4,809,016 | A | 2/1989 | Padalino |
| 5,070,345 | A | 12/1991 | Lahut et al. |
| 5,099,256 | A | 3/1992 | Anderson |
| 5,124,720 | A | 6/1992 | Schantz |
| 5,398,053 | A | 3/1995 | Hirosawa et al. |
| 5,796,418 | A | 8/1998 | Silverbrook |
| 5,953,034 | A | 9/1999 | Salomon et al. |
| 6,354,701 | B2 | 3/2002 | Korem |

FOREIGN PATENT DOCUMENTS

| | | |
|---|---|---|
| WO | WO 97/18950 | 5/1997 |

*Primary Examiner*—Raquel Yvette Gordon
(74) *Attorney, Agent, or Firm*—Piper Rudnick LLP

(57) ABSTRACT

An inkjet printing method ejects fluid droplets onto a transfer surface. On the transfer surface the droplets are treated. The droplets are then transferred to a substrate. The treatment decreases the sizes of the dots and increases their viscosity. Adjacent dots in the pattern may be printed in separate passes to retain dot integrity. The droplets may comprise UV-curable inks. The droplets may be partially cured by exposure to UV radiation while on the transfer surface.

58 Claims, 6 Drawing Sheets

METHOD FOR IMAGING WITH UV CURABLE INKS

CROSS-REFERENCE TO RELATED APPLICATIONS

This is a continuation-in-part of U.S. patent application Ser. No. 09/654,247, filed Mar. 8, 1999, now issued as U.S. Pat. No. 6,409,331 entitled METHODS FOR TRANSFERRING FLUID DROPLET PATTERNS TO SUBSTRATES VIA TRANSFERRING SURFACES. This application is related to the subject matter of application Ser. No. 09/071,295 entitled IMPROVED RESOLUTION INKJET PRINTING and application Ser. No. 09/107,902 entitled MULTIPLE PASS INK JET RECORDING. Each of these applications is hereby incorporated by reference.

FIELD OF THE INVENTION

The invention pertains to the general field of printing and in particular to inkjet printing.

BACKGROUND OF THE INVENTION

Ink jet technology may be used to deposit fluid materials on substrates. Ink jet technology has numerous applications, mainly in printing. Ink jet printers function by depositing small droplets of fluid at desired positions on a substrate. There are various ink jet printing technologies. Many of these technologies can be classified in two general categories. Continuous ink jet printing involves electrically charging a stream of droplets and then deflecting the stream directly or indirectly onto a substrate. "Drop on demand" (DOD) inkjet printing has an actuator connected to an ink supply. The actuator creates ink droplets on demand. The actuator may comprise, for example, a piezoelectric actuator.

Ink jet printing suffers form a number of drawbacks. Ink jet printing is typically slower than traditional offset printing. This is especially true for process color printing. For example, the linear printing speed of inkjet printing is typically of the order of 10 times slower than can be achieved in offset printing. This represents a major issue limiting the implementation of inkjet technology in industrial printing systems. The inkjet printing speed limit is dictated by the rate at which inkjet nozzles can eject ink in discrete controllable amounts. This rate is at present on the order of 20,000 pulses per second for DOD inkjet printers. This limits state of the art DOD inkjet printers to print rates on the order of 2 pages per second. Continuous ink jet printing can be performed more quickly. However, at high speeds, the results tend to be poor. Quality may be improved by printing at slower speeds.

Inkjet printing typically cannot achieve printing quality as high as can be achieved using offset printing techniques. Inkjet printing is often characterized by a distinctive banding pattern that is repeated over the printed image. This may be traced to the arrangement of the inkjet nozzles in the printing head. Relatively small nozzle misalignments or off-center emission of droplets can cause banding. As the printing head is translated laterally across the width of the printing surface, the visual imperfections are periodically repeated. This produces banding or striping which is characteristic of inkjet printers. A number of approaches exist to control banding. These approaches reduce throughput of the printer.

Print quality of inkjet printers is also reduced by "wicking" or "running". The low-viscosity water-based inks typically employed in ink-jet printers tends to "run" along the fibers of certain grades of paper. This phenomenon is also referred to as "wicking" and leads to reduced quality printing, particularly on the grades of paper employed in volume printing. Wicking can cause printed dots to become much larger than the droplet of ink emerging from the inkjet nozzle.

It is possible to reduce wicking by printing on specially treated paper. However, such paper tends to be undesirably expensive.

The matter of failure in inkjet nozzles is also deserving of attention. Various approaches exist for detecting faulty inkjet nozzles and for re-addressing the inkjet printing head to permit other nozzles to perform the tasks of faulty nozzles. This includes various redundancy schemes. Again, these usually have the effect of slowing down the net printing process speed. In many cases the redundancy is managed at printing head level, requiring backups for entire printing heads. This adds to the cost of the technology per printed page and again limits the industrial implementation of the technology.

The prior art describes various array inkjet print head designs aimed at reducing inkjet-printing artifacts such as banding. Examples are Furukawa in U.S. Pat. No. 4,272,771, Tsao in U.S. Pat. No. 4,232,771, Padalino in U.S. Pat. No. 4,809,016 and Lahut in U.S. Pat. No. 5,070,345. Considerable work has also been done in addressing reliability by providing inkjet nozzle redundancy. Examples are Schantz in U.S. Pat. No. 5,124,720, Hirosawa in U.S. Pat. No. 5,398,053 and Silverbrook in U.S. Pat. No. 5,796,418. Transfer rollers have also been described, both with and without the droplets deposited on them being processed in some way before final printing in order to reduce wicking. See for example Takita in U.S. Pat. No. 4,293,866, Durkee in U.S. Pat. No. 4,538,156, Anderson in U.S. Pat. No. 5,099,256, Sansone in U.S. Pat. No. 4,673,303 and Salomon in U.S. Pat. No. 5,953,034.

There is a need for inkjet printing methods which provide combinations of print quality, speed and cost which improve on the prior art.

SUMMARY OF THE INVENTION

This invention, provides an inkjet printing method in which inkjet droplets are deposited onto an intermediate transfer surface. On the transfer surface the droplets are treated to decrease their sizes and to increase their viscosities. The treated droplets are then transferred to a printing surface. Dots immediately adjacent to one another in the pattern may be printed in separate passes to retain dot integrity. The droplets may comprise droplets of a UV-curable material and the treatment may comprise exposing the droplets to ultraviolet light while on the transfer surface. The transfer surface may optionally be patterned.

Further aspects of the invention and features of specific embodiments of the invention are described below.

BRIEF DESCRIPTION OF THE DRAWINGS

In drawings which illustrate non-limiting embodiments of the invention.

DETAILED DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
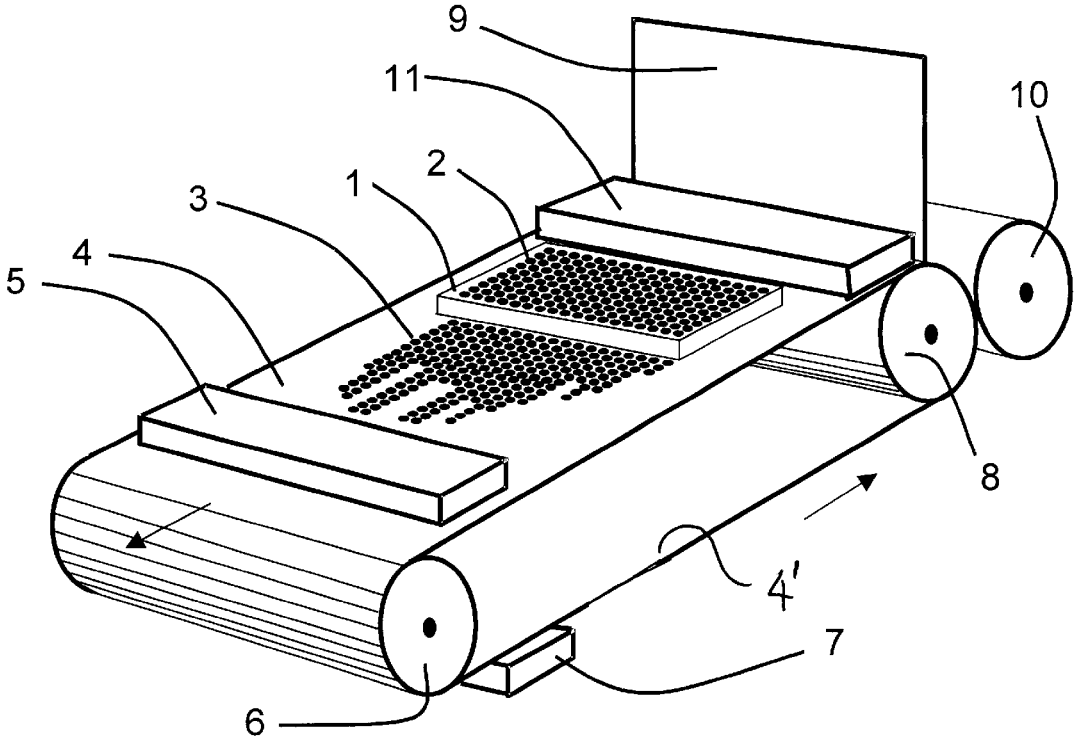
FIG. 1 is a partly schematic isometric view of a two-stage fluid droplet transfer unit.

FIG. 1 shows an apparatus 100 which includes an inkjet head 1 comprising rows and columns of inkjet nozzles 2 arranged to deposit fluid droplets in a fluid droplet pattern 3 on a transfer surface 4. Pattern 3 is set by the control signals provided to the inkjet nozzles 2 by a controller (not shown in FIG. 1). In this embodiment, transfer surface 4 comprises a continuous belt 4' moving in the direction indicated by the arrows. While inkjet nozzles are employed as sources of fluid droplets in preferred embodiments of the invention, the fluid droplet sources may be of other suitable types and the fluid may be an inkjet ink or another ink, a pigment or a resin or any fluid required to create an image or pattern. In the embodiment of FIG. 1, the fluid droplet sources comprise inkjet nozzles 2 which eject droplets of ink.

Inkjet droplet pattern 3 is subjected to post-deposition processing by post-deposition processing unit 5 the processing changes properties of the ink droplets of pattern 3. While the post-deposition treatment may comprise one or more of:

irradiation with ultra-violet light, vacuum treatment, airflow chemical treatment, and, heat treatment.

Heat treatment may comprise one or more of microwave heating, radiative heating or conduction heating.

Figure 2A:
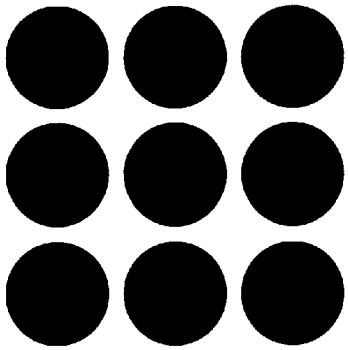
FIG. 2A shows a pattern of inkjet droplets on a transfer surface.
Figure 2B:
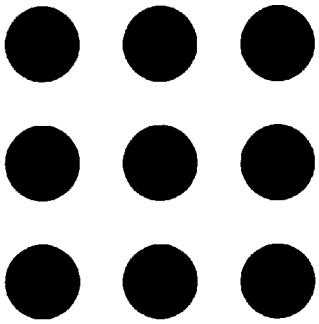
FIG. 2B shows the inkjet droplet pattern of FIG. 2A on the transfer surface after processing.
Figure 2C:
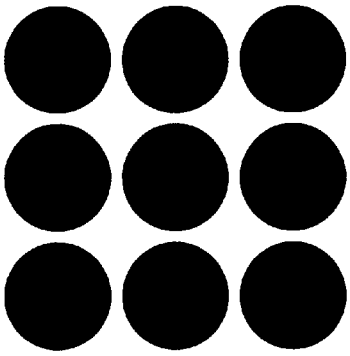
FIG. 2C shows the inkjet droplet pattern of FIG. 2B after transfer to a printing surface.

As shown in FIGS. 2A through 2C, the post-deposition treatment reduces the size of the fluid droplets and changes their rheological properties. For example, the post-deposition treatment may increase a viscosity of the droplets in pattern 3.

In the embodiment of FIG. 1, continuous belt 4' rolls around rollers 6 and 8. A printing medium 9 is compressed against roller 8 by an elastomeric roller 10. Droplet pattern 3 is transferred from belt 4' to a surface of medium 9 at the location where medium 9 passes between rollers 8 and 10. Medium 9 may comprise paper, plastic, polyester, a polymeric material or another material to be printed on or, in general, any substrate to which a fluid-droplet pattern may be transferred. The fluid used to create pattern 3 is chosen to be compatible with medium 9. Medium 9 may be in the form of individual sheets or in the form of a continuous roll. Medium 9 could comprise a printed circuit board or a lithographic mask.

In embodiments where the post-deposition treatment comprises heating, surface 4 should be cooled to a temperature compatible with the type of medium 9 being printed upon before it comes into contact with medium 9. In the embodiment of FIG. 1, this is accomplished by providing surface 4 on an elongated belt 4' and also by providing a belt-cooling unit 7.

The post-deposition treatment of the droplets of pattern 3 facilitates droplet transfer while preserving dot integrity. Dot integrity is preserved when the shape (i.e. the outline of a dot on the surface of medium 9) is preserved and is consistent from dot to dot. Dots that are deformed from a geometric shape anticipated by the design of the nozzles and the transferring surface, or droplets that have coalesced, therefore represent a loss in dot integrity.

Belt 4' is cleaned by a pre-cleaning unit 11 that removes any remaining ink in preparation for the deposition of more droplets by nozzle array 2. If it is necessary or desirable to control the affinity of the surface of the continuous belt for the fluid droplets being deposited on it, pre-cleaning unit 11 may clean surface 4 using a liquid hydrophobic cleansing agent which may be sprayed on or wiped on.

The effect of a post-deposition treatment process on the dots of pattern 3 is illustrated in more detail in FIGS. 2A to 2D. FIG. 2A shows droplets as deposited on surface 4. FIG. 2B shows the same droplets after they have been heated. The droplets of FIG. 2B have shrunken because the heating has caused much of the solvent in the droplets (the solvent is water in most industrial inkjet inks) to turn to vapor. The heat treatment also changes rheological properties of the droplets. In particular, the viscosity of the droplets increases. The surface tension of the droplets ensures that they maintain integrity as they shrink due to the loss of solvent. In some embodiments, at least 40% or at least 50% of the solvent initially present in the droplets is evaporated in a post-deposition process.

The pattern of reduced-size, higher-viscosity droplets is then transferred to the surface of medium 9. The increased viscosity of the droplets reduces the "wicking" or "running" of the droplets on medium 9. In the transfer process, the droplets are flattened and therefore the dot size increases upon transfer. The dot size on the printing surface is controlled by the choice of processing temperatures and transfer pressures on the rollers and the paper. The result is shown in FIG. 2C.

The increased viscosity of the droplets facilitates improved control over the inkjet printing process. The dot integrity of pattern 3 as deposited on surface 4 may be maintained on a wide range of media 9. Standard high-volume printing paper of types used for offset-printing that has not specifically been treated for purposes of inkjet printing may be used as a medium 9.

By way of example, surface 4 may comprise PEARL-dry™ waterless printing plate supplied by the Presstek company of Hudson, N.H. Surface 4 may be coated with Scotchgard™ Leather Protector from the 3M company of St. Paul, Minn. to make it hydrophobic. The ink may be that employed in the HPC4844A cartridge supplied by the Hewlett-Packard company of Palo Alto, Calif. and it may be deposited as fluid droplets on the treated plate by means of an inkjet head from an HP 2000C inkjet printer supplied by the same company. A range of droplet sizes may be obtained.

In some embodiments the post deposition treatment causes the droplets to shrink from a first diameter to a second diameter. In some embodiments the second diameter is 85% or less of the first diameter. For example, with one choice of printing conditions, droplets which are 25 microns in diameter as deposited on surface 4. The droplets are shrunk to 20 microns in diameter upon heating at 120 C. for 60 seconds. The droplets widen to 35 microns in diameter when printed onto regular paper, not specially treated for inkjet printing. When conventional inkjet printing is employed to print on the same regular paper, the same ink and head tend to print irregularly shaped dots on the order of 75 microns in diameter.

Figure 2D:
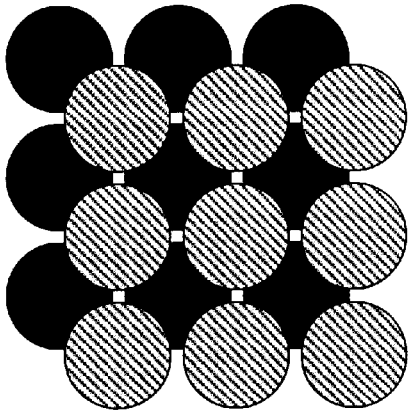
FIG. 2D shows the inkjet droplet pattern of FIG. 2C after transfer of a second set of inkjet droplets.

To achieve adequate coverage and a complete set of grey tones or color densities, it may be desirable to arrange droplet pattern 3 so that immediately adjacent nearest-neighbor droplets overlap to some degree on the surface of medium 9. This overlap arrangement of immediately adjacent dots is shown in FIG. 2D. If droplets occupying all possible positions in the pattern were deposited on the transfer surface at the same time, then some dots would likely touch and coalesce, with a consequential loss of dot integrity.

Print dot integrity may be enhanced by performing the printing process in two or more steps as shown in FIGS. 2A through 2C. In this embodiment, droplets intended to occupy immediately adjacent positions in the final printed pattern are deposited in separate steps. In the first step a first subset of droplets is deposited such that immediately adjacent nearest neighbor droplet positions are not occupied. In FIG. 2D, the dots so obtained are depicted as solid dots. In a second step an interleaved subset of dots, depicted by the hatched dots in FIG. 2D and representing droplet positions in the final printed pattern that would be immediately adjacent nearest neighbors to the first subset, is printed. The two steps may be achieved by either running the paper through the same printing system twice or by having two entirely separated printing systems operating serially on the same medium 9.

In one embodiment the fluid used to print with is water-based industrial inkjet ink and at least two printing units are employed. In a more general case any number of such printing units is used. The printing units deposit droplets as described above with reference to FIGS. 2A through 2C. No two droplets touch each other during the entire transfer process, unless they have first been through post-deposition processing. Therefore, the droplets have no opportunity to coalesce while in their un-processed states.

Figure 3:
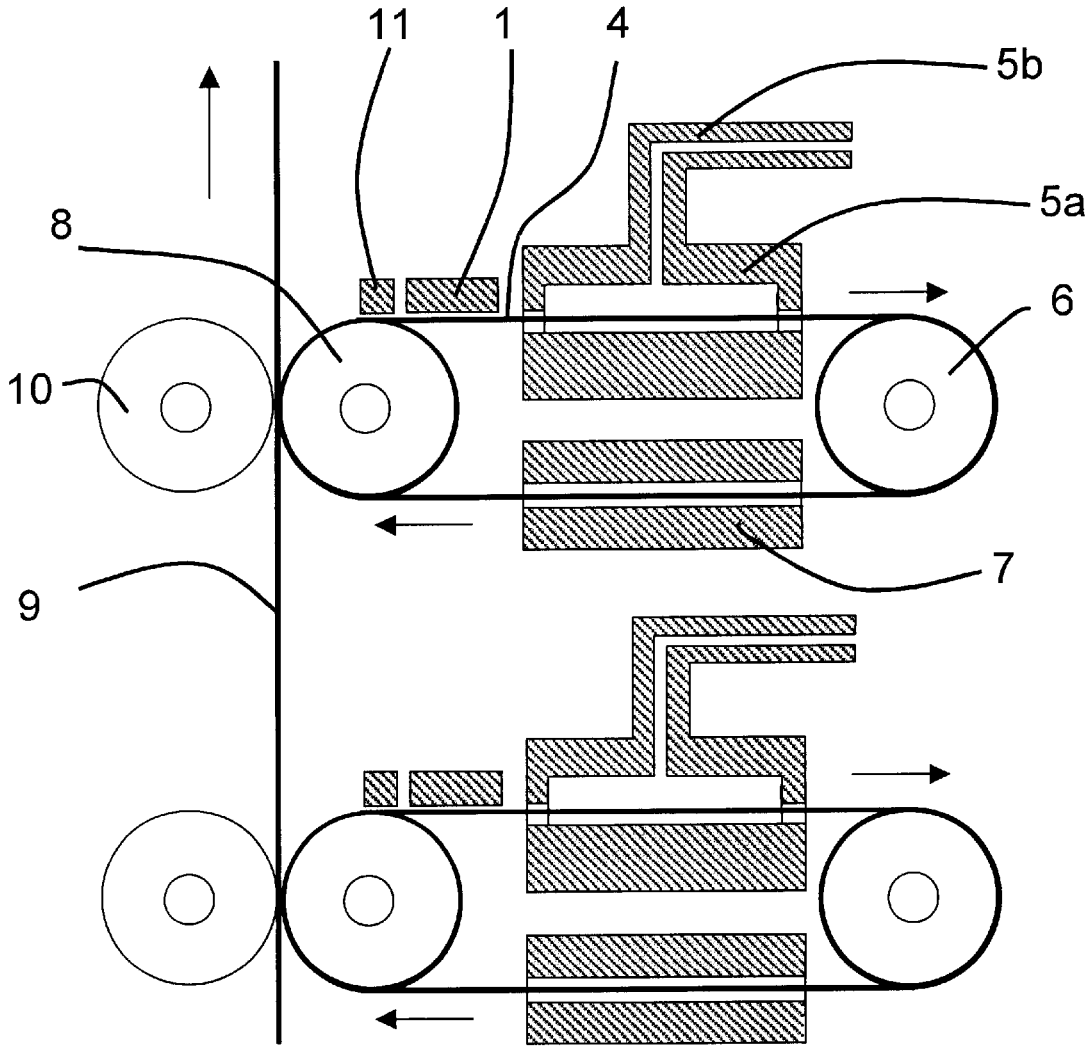
FIG. 3 shows two two-stage fluid droplet transfer units arranged to print two inkjet droplet patterns in succession on the same printing surface.

FIG. 3 shows a printing system comprising two printing units arranged in series. The two units may be substantially identical. In this embodiment, post-deposition treatment unit 5 comprises a thermal processing unit which comprises a heating system 5*a*, and a vapor extraction unit 5*b*. Vapor extraction unit 5*b* forcibly removes solvents (such as water vapor) emitted by the heated fluid droplets during processing. Medium 9 is shown in FIG. 3 as being continuous and moving in the direction indicated by the arrow.

Belt-cooling unit 7 assists in maintaining registration between the patterns deposited by the two printing units of FIG. 3 when multiple printing units are employed. Belt-cooling unit 7 prevents excessive thermal expansion of belt 4'. Any suitable system may be used for maintaining synchronization between the belts 4' of the two printing units. Synchronization control systems for continuous belts are well known and will not be described here.

Figure 4:
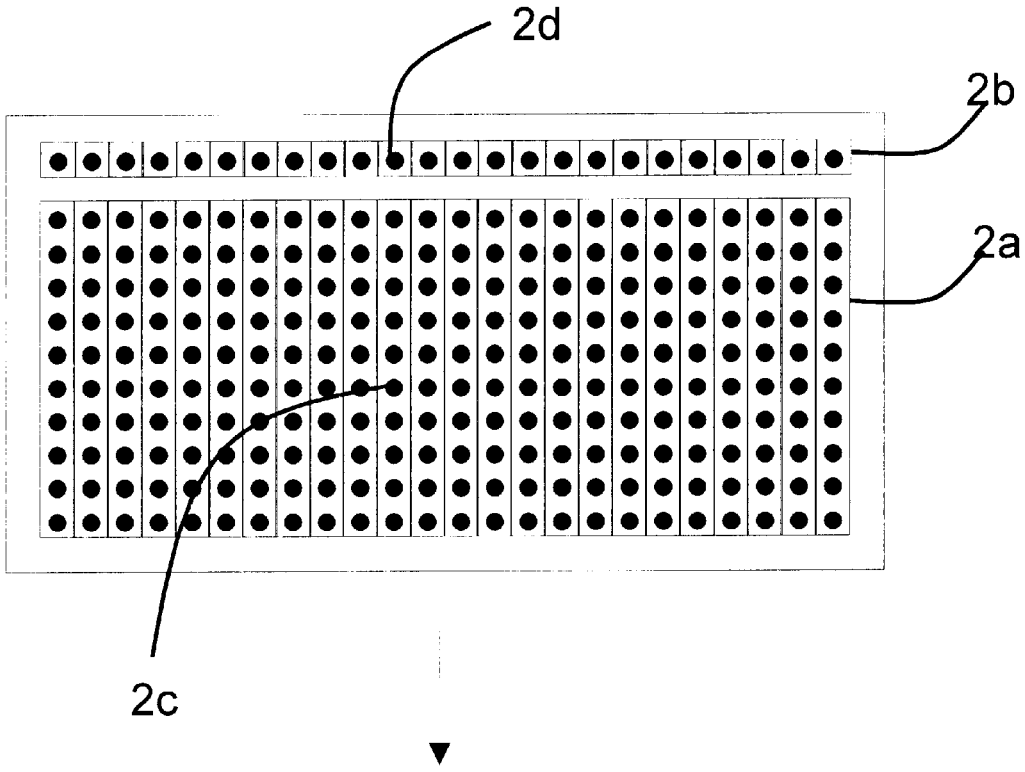
FIG. 4 shows a multi-row serial ink jet nozzle head with a single redundant backup row of nozzles.

FIG. 4 shows an inkjet head 1 which may be used in this invention. Head 1 has inkjet nozzles arranged in rows and columns. The term "column" means a row of nozzles extending generally along the direction of motion of the transferring surface relative to the inkjet head as indicated by the arrow. The term "rows" means a row of nozzles in the remaining dimension. Ink jet head 1 has a primary array 2*a* and a secondary array 2*b*. Primary array 2*a* may have any number of rows and columns. The specific embodiment of FIG. 4 has 24 columns of in-line nozzles arranged in 10 rows. Nozzles or fluid droplet sources in general are "in-line" or "aligned" when they are arranged in a straight line along the direction of motion of the transferring surface relative to the array of droplet sources. To this end the alignment of the nozzles need only be within the tolerance accepted for the printed line-width in the direction of motion of the transferring surface.

For the sake of simplicity and clarity, FIG. 4 depicts the nozzles of ink jet head 1 as being in straight rows. However, the invention presented here is not restricted to this arrangement. In the general case the rows of nozzles do not need to be perpendicular to the columns, nor do the rows need to be straight or the placement of the nozzles regular, as long as the nozzles in a column are placed directly in-line with the direction of motion of the transfer surface. It is common practice in industry to have the rows non-linear and in various staggered formats. Any of these variations are compatible with the invention presented here as long as a given column of nozzles prints in-line.

Secondary array 2*b* comprises one or more rows of redundant nozzles. The embodiment of FIG. 4 shows a secondary array with one row of nozzles. The term "redundant" means for backup and does not mean superfluous. Should, for example, nozzle 2*c* become blocked or intermittent or break, the control system of the print head will sense this failure and will cause the role of nozzle 2*c* to be taken over by redundant nozzle 2*d* with the timing signal appropriately adapted. The matter of timing management for inkjet nozzles is well established in the industry and will not be detailed here. Systems for detecting failing nozzles and automatically replacing them have also been described and will not be discussed here.

The redundant nozzles must be in-line with the nozzles they replace, even if nozzles within a redundant row are not arranged in a straight line. The placement of redundant nozzles in-line with the nozzles they are designed to replace, allows for the use of a single redundant nozzle to serve as back-up for a number of different main nozzles in-line with it without requiring the inkjet head to be laterally translated to bring the redundant nozzle into operation. Maximum printing speeds may therefore be retained despite there not being one redundant nozzle for every main nozzle. This arrangement allows redundancy to be implemented at very low cost whilst maintaining high printing speeds. As with the main nozzles, the alignment of the redundant nozzles with the main nozzles in the direction of motion of the transferring surface need only be within the tolerance accepted for the printed line-width in the direction of motion of the transferring surface.

The in-line arranged columns of inkjet nozzles in the primary array 2*a* allow the writing of each printing track by a plurality of nozzles. The nozzles may all be part of a single head assembly. This averages out any variations between nozzles. Banding and striping, which are typical visual imperfections characterizing inkjet printing, are therefore greatly reduced without the throughput loss arising from more standard techniques such as interleaving and overwriting.

By placing the nozzles in a column aligned with the direction of motion of transferring surface 4, the printing speed may be increased by a factor equal to the number of rows (or the number of nozzles in a column). The printing head 1 illustrated in FIG. 4, permits the printing speed to be multiplied by a factor 10 (since primary array 2*a* has 10 rows of nozzles).

Figure 5:
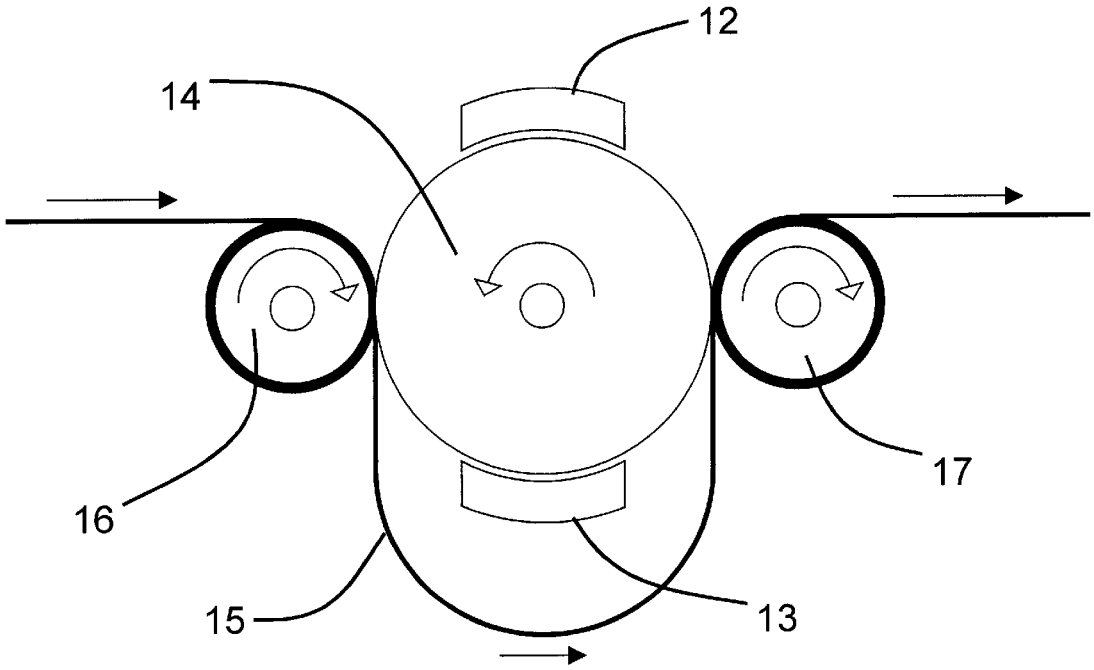
FIG. 5 shows apparatus for practising a fluid droplet transfer method according to an alternative embodiment of the invention; and, FIG. 6 shows apparatus for practising a method according to an alternative embodiment of the invention which includes a paper treatment step.

In an alternative embodiment of the invention shown in FIG. 5, inkjet heads 12 and 13 deposit inkjet patterns on drum roller 14. Each of the patterns is a subset of the total pattern such that, when correctly combined, they constitute the complete pattern. As drum roller 14 rotates it transfers the subset droplet patterns to a printing surface 15 that is in the form of a looped continuous reel. The inkjet heads are controlled by a controller (not shown in FIG. 5), that ensures the appropriate programmed delay between the sets of data representing the patterns being printed. At any given moment in time the inkjet heads 12 and 13 will be printing subset patterns of different images, as determined by the extent of the loop in the continuous reel of paper. The programmed delay is timed to compensate exactly for the loop in the continuous reel 15. Again, in keeping with standard practice in the industry, rollers 16 and 17 may be elastomeric.

In yet another alternative embodiment of the invention, transfer surface 4 has a patterned surface. This surface is chosen to be hydrophobic and has upon it a pattern of areas where water-based ink droplets preferentially locate themselves. This may be achieved by a variety of means including making these areas less hydrophobic, by creating a physical pattern on the surface that allows the droplets to locate there or any other means that will induce the droplets to locate there in order to minimize the surface energy. This includes the selective electrostatic charging of the surface. By this approach the droplets will self-correct their spatial registration when deposited onto transfer surface 4 and thereby automatically correct for any off-center droplet emission by the relevant inkjet nozzles and improve the quality of the printed image. This process need not be restricted to water-based inks. The requirement is merely that the affinity of the transfer surface for the fluid droplets vary in a pattern as described above, allowing the fluid droplets to locate at such positions as will minimize the surface energy.

Figure 6:
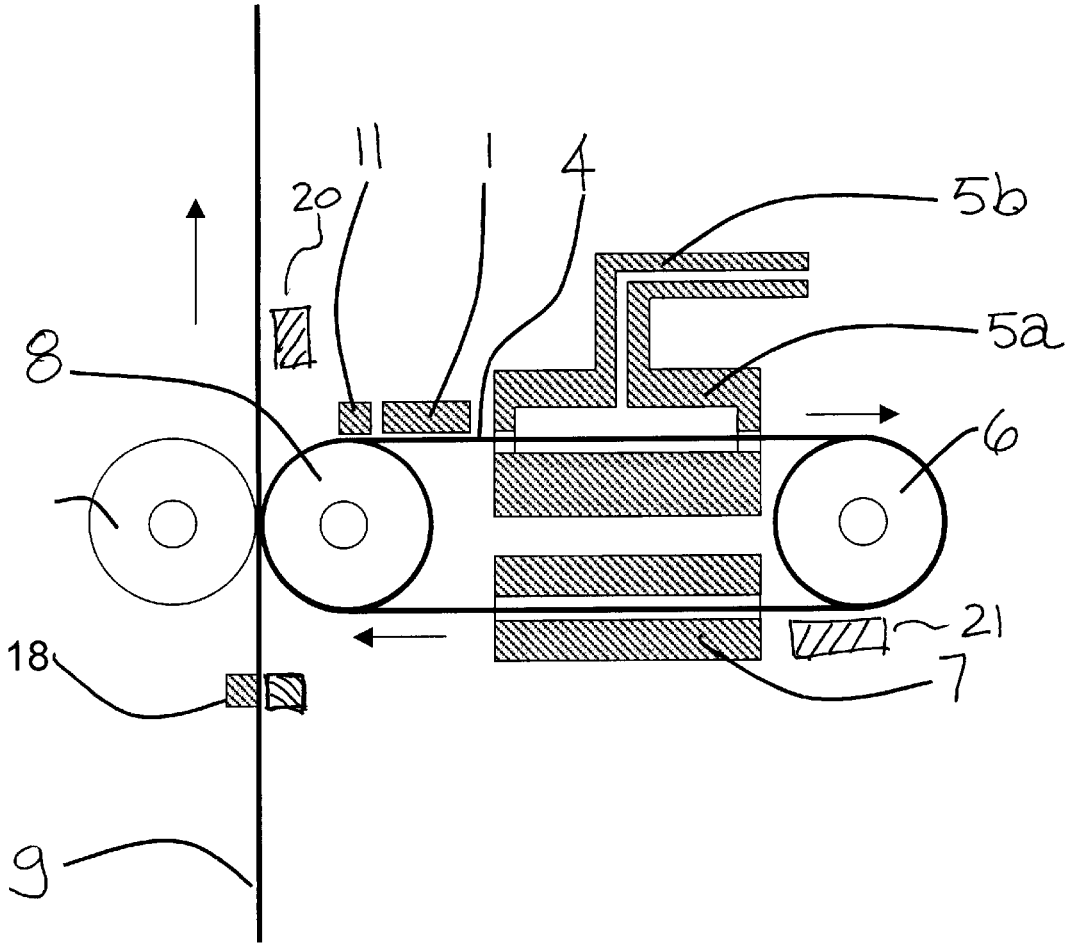

FIG. 6 shows a still further embodiment of the invention which comprises a two-stage fluid droplet transfer unit. In the embodiment of FIG. 6, a printing medium 9 is treated to improve the dot integrity. The treatment is applied by a paper treatment unit 18 which is located to treat medium 9 (typically regular paper) before it passes between rollers 8 and 10. One example of a treatment of the paper is to spray it with a hydrophobic liquid.

In one embodiment of the invention, the fluid droplets comprise droplets of an ultraviolet (UV) curable ink. The ink may comprise a UV curable screen printing ink. The ink may comprise a relatively high viscosity UV curing oligomer in a volatile solvent. An oligomer is a polymer or collection of polymers and monomers that can be further reacted to form a larger polymer. The UV curable ink may comprise, for example, a dye or pigment and a mixture of UV pre-polymers and photoinitiators together with a mixture of one or more volatile solvents. The amount of solvent is chosen so that the ink has a viscosity suitable for inkjet printing. This is most typically in the range of about 2 to about 30 centipoise. The pre-polymers may comprise mixtures of acrylic oligomers and monomers and may also include diluents. Alternatively, cationic curing systems incorporating solvents may also be used.

The fluid droplets are applied to a medium 9 as described above. Before being applied to printing medium 9, most of the solvent is removed from the droplets. Removing the solvent may comprise heating the droplets. This may be performed by post-deposition processing unit 5. Optionally, the droplets of UV curable ink may be partially cured while on transfer surface 4. Such partial curing may be initiated by exposing pattern 3 to ultraviolet light. This may be achieved, for example, by providing a UV light source 21 which illuminates pattern 3 on transfer surface 4. Light source 21 may be considered to be a post-deposition processing unit. The partial curing of the fluid droplets of pattern 3 further thickens the ink before transfer and final curing. After being applied to printing medium 9, the droplets are cured by exposing them to ultraviolet light from, for example, an exposure unit 20 (see FIG. 6). UV light from a single UV light source may be used both to partially cure the fluid droplets on transfer surface 4 and to cure the fluid droplets on substrate 9.

The solvent is preferably collected. The collected solvent can either be removed from the machine or can be used to dilute an ink concentrate and re-used.

This choice of ink has a number of advantages including:

the solvent-depleted ink droplets which result from the post-deposition treatment have a high viscosity and therefore will retain a small dot size;

the UV curing of the ink on substrate 9 may occur almost instantaneously;

substrate 9 may comprise any of a wide range of media.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A printing method comprising:

depositing a pattern of droplets of a fluid comprising a UV-curable material in a solvent onto a transfer surface;

while the droplets are on the transfer surface, allowing solvent to evaporate from the droplets;

transferring the pattern of droplets onto a substrate; and, while the droplets are on the substrate, curing the UV-curable material by exposing the transferred pattern of droplets to UV light.

2. The method of claim 1 comprising exposing the droplets to UV light while the droplets are on the transfer surface.

3. The method of claim 1 wherein the transfer surface comprises a surface of a first rotating cylinder and transferring the pattern of droplets onto the substrate occurs at a location where the substrate passes between the rotating cylinder and a pressure surface.

4. The method of claim 3 comprising controlling a pressure compressing the transfer surface against the substrate at the location where the substrate passes between the rotating cylinder and the pressure surface.

5. The method of claim 3 wherein the pressure surface comprises a second rotating cylinder.

6. The method of claim 1 wherein the transfer surface comprises a surface of a belt and the method comprises circulating the belt while depositing the pattern of droplets onto the belt.

7. The method of claim 6 wherein transferring the pattern of droplets onto the substrate occurs at a location where the substrate passes between the belt and a pressure surface.

8. The method of claim 7 comprising controlling a pressure compressing the transfer surface against the substrate at the location where the substrate passes between the belt and the pressure surface.

9. The method of claim 7 wherein the pressure surface comprises a rotating cylinder.

10. The method of claim 1 wherein allowing solvent to evaporate from the droplets comprises heating the droplets.

11. The method of claim 10 wherein heating the droplets comprises exposing the droplets to microwave energy.

12. The method of claim 10 wherein heating the droplets comprises exposing the droplets to radiant heat.

13. The method of claim 10 wherein heating the droplets comprises blowing a heated gas over the droplets.

14. The method of claim 10 wherein heating the droplets comprises heating the transfer surface and the method comprises cooling the transfer surface after heating the pattern of droplets.

15. The method of claim 14 comprising cooling the transfer surface before transferring the pattern of droplets onto the substrate.

16. The method of claim 15 wherein transferring the pattern of droplets onto the substrate occurs at a location where the substrate passes between the belt and a pressure surface.

17. The method of claim 16 comprising controlling a pressure compressing the transfer surface against the substrate at the location where the substrate passes between the belt and the pressure surface.

18. The method of claim 14 wherein the transfer surface comprises a surface of a belt and the method comprises circulating the belt while depositing the pattern of droplets onto the belt.

19. The method of claim 1 comprising cleaning the transfer surface prior to depositing the pattern of droplets on the transfer surface.

20. The method of claim 19 wherein cleaning the transfer surface comprises applying a liquid hydrophobic cleansing agent to the transfer surface.

21. The method of claim 1 wherein allowing the solvent to evaporate from the droplets comprises allowing the droplets to shrink from a first diameter to a second diameter wherein the second diameter does not exceed 85% of the first diameter.

22. The method of claim 1 used to print an image comprising one or more adjacent nearest-neighbor droplets, the method comprising:

depositing onto a first transfer surface a first pattern of droplets in which immediately-adjacent nearest-neighbor droplet positions are not occupied;

while the droplets of the first pattern of droplets are on the first transfer surface, allowing solvent to evaporate from the droplets; and, depositing onto a second transfer surface a second pattern of droplets in which immediately-adjacent nearest-neighbor droplet positions are not occupied;

while the droplets of the second pattern of droplets are on the second transfer surface, allowing solvent to evaporate from the droplets;

sequentially transferring the first and second patterns of droplets onto a substrate to provide an image comprising one or more adjacent nearest-neighbor droplets;

and, while the droplets of the first and second droplet patterns are on the substrate, curing the UV-curable material by exposing the transferred first and second patterns of droplets to UV light.

23. The method of claim 22 wherein at least some droplets of the first and second patterns of droplets overlap on the substrate.

24. The method of claim 22 wherein the first and second transfer surfaces are provided by a common transfer surface.

25. The method of claim 1 wherein depositing the pattern of droplets of the fluid onto the transfer surface comprises expelling the droplets of the pattern from an ink jet printing nozzle.

26. The method of claim 25 wherein, upon being ejected from the inkjet nozzle, the fluid has an viscosity in the range of 2 to 30 centipoise.

27. The method of claim 25 wherein allowing solvent to evaporate from the droplets comprises reducing an amount of solvent in each of the droplets by 50% or more.

28. The method of claim 27 comprising extracting vapors of the evaporated solvent, condensing the vapors to yield a recycled solvent wherein the fluid comprises some recycled solvent.

29. The method of claim 1 wherein the transfer surface is patterned with a plurality of areas where water-based ink droplets preferentially locate themselves.

30. The method of claim 29 wherein the transfer surface is patterned with a pattern that is periodic in at least one dimension.

31. The method of claim 30 wherein the periodic pattern modifies a spatial registration of the fluid droplets.

32. The method of claim 29 comprising patterning the transfer surface by selectively imparting electrostatic charges to the transfer surface.

33. The method of claim 1 wherein the droplets have diameters in excess of 23 microns when deposited onto the transfer surface and have diameters of less than 21 microns when transferred to the substrate.

34. A method for printing a pattern on a substrate, the method comprising:

depositing droplets of fluid ink comprising a solvent onto a transfer surface;

while the droplets are on the transfer surface, allowing the solvent to evaporate until at least 40% of the solvent initially present in each of the fluid droplets has evaporated; and, transferring the droplets from the transfer surface to the substrate.

35. The method of claim 34 wherein, depositing the droplets comprising ejecting the droplets from nozzles of one or more inkjet print heads.

36. The method of claim 35 wherein, upon being ejected from the inkjet nozzles, the droplets have a viscosity in the range of 2 to 30 centipoise.

37. The method of claim 34 wherein allowing solvent to evaporate from the droplets comprises reducing an amount of solvent in each of the droplets by 50% or more.

38. The method of claim 34 comprising depositing immediately adjacent fluid droplets in the pattern onto the transfer surface at different times.

39. The method of claim 34 wherein the fluid comprises an initiator sensitive to a type of radiation and the method comprises curing the droplets on the substrate by exposing the droplets to the type of radiation.

40. The method of claim 39 wherein the initiator comprises a photoinitiator and the type of radiation is ultraviolet radiation.

41. The method of claim 40 comprising partly curing the droplets on the transfer surface by exposing the droplets to the ultraviolet radiation while on the transfer surface.

42. The method of claim 39 comprising partly curing the droplets on the transfer surface by exposing the droplets to the type of radiation while on the transfer surface.

43. The method of claim 34 wherein the solvent comprises water.

44. The method of claim 43 wherein the transfer surface comprises a hydrophobic surface.

45. The method of claim 44 wherein a hydrophobicity of the transfer surface varies periodically in at least one dimension.

46. The method of claim 45 wherein the hydrophobicity of the transfer surface varies periodically in two dimensions.

47. The method of claim 46 comprising allowing at least some of the droplets to move on the transfer surface to locations at which free energies of the droplets are reduced relative to locations at which the droplets initially contact the transfer surface.

48. The method of claim 34 wherein allowing solvent to evaporate from the droplets comprises heating the droplets.

49. The method of claim 48 wherein heating the droplets comprises exposing the droplets to microwave energy.

50. The method of claim 48 wherein heating the droplets comprises exposing the droplets to radiant heat.

51. The method of claim 48 wherein heating the droplets comprises blowing a heated gas over the droplets.

52. The method of claim 48 wherein heating the droplets comprises heating the transfer surface.

53. The method of claim 52 comprising cooling the transfer surface after heating the pattern of droplets.

54. The method of claim 53 comprising cooling the transfer surface before transferring the droplets onto the substrate.

55. The method of claim 34 wherein the substrate comprises a substrate selected from the group consisting of: papers, plastics, polyesters, polymeric materials, printed circuit board material, and lithographic masks.

56. The method of claim 34 wherein depositing the droplets of fluid ink on the transfer surface comprises ejecting the droplets from fluid droplet sources of a two-dimensional array of fluid droplet sources, the two-dimensional array comprising a plurality of sets of fluid droplet sources, each set of fluid droplet sources comprising two or more fluid droplet sources that are aligned with one another in a direction of motion of said transfer surface relative to the array.

57. The method of claim 34 wherein allowing the solvent to evaporate comprises applying a vacuum to reduce a pressure around the deposited droplets.

58. The method of claim 34 wherein the droplets have diameters in excess of 23 microns when deposited onto the transfer surface and have diameters of less than 21 microns when transferred to the substrate.

* * * * *

UNITED STATES PATENT AND TRADEMARK OFFICE

CERTIFICATE OF CORRECTION

PATENT NO. : 6,755,519 B2
DATED : June 29, 2004
INVENTOR(S) : Gelbart et al.

It is certified that error appears in the above-identified patent and that said Letters Patent is hereby corrected as shown below:

Title page,
Item [63], Related U.S. Application Data, delete "filed on March 8, 1999" and insert therefor -- filed on August 30, 2000 --

Signed and Sealed this

Thirtieth Day of November, 2004

JON W. DUDAS
*Director of the United States Patent and Trademark Office*